US007621061B2

(12) United States Patent
Drescher et al.

(10) Patent No.: US 7,621,061 B2
(45) Date of Patent: Nov. 24, 2009

(54) ARCHITECTURAL ELEMENT FOR WALL BOARD

(76) Inventors: Susan Drescher, 11135 McClumpha Rd., Plymouth, MI (US) 48170; Stephan Koerner, 11135 McClumpha Rd., Plymouth, MI (US) 48170

( * ) Notice: Subject to any disclaimer, the term of this patent is extended or adjusted under 35 U.S.C. 154(b) by 0 days.

(21) Appl. No.: 11/774,141

(22) Filed: Jul. 6, 2007

(65) Prior Publication Data

US 2008/0120885 A1 May 29, 2008

Related U.S. Application Data

(60) Provisional application No. 60/806,782, filed on Jul. 8, 2006.

(51) Int. Cl.

| | |
|---|---|
| ***A47G 1/06*** | (2006.01) |
| ***G09F 7/18*** | (2006.01) |
| ***E04F 19/00*** | (2006.01) |
| ***E04H 14/00*** | (2006.01) |
| ***E04B 1/00*** | (2006.01) |

(52) U.S. Cl. ..... 40/800; 52/38; 52/27; 52/745.2; 312/242

(58) Field of Classification Search ..... 40/800; 52/38, 27, 745.2; 312/242

See application file for complete search history.

(56) References Cited

U.S. PATENT DOCUMENTS

| | | | | |
|---|---|---|---|---|
| 4,258,488 | A * | 3/1981 | Schienbein | 40/800 |
| 4,681,380 | A * | 7/1987 | Carlin | 312/242 |
| 4,955,154 | A * | 9/1990 | Moss | 40/663 |
| 5,707,125 | A * | 1/1998 | Coglin | 312/242 |
| 6,207,119 | B1 * | 3/2001 | Diccianni et al. | 422/295 |
| 6,896,833 | B2 | 5/2005 | Chadwick | |

* cited by examiner

*Primary Examiner*—Lesley D Morris
*Assistant Examiner*—Syed A Islam
(74) *Attorney, Agent, or Firm*—Rader, Fishman & Grauer, PLLC

(57) ABSTRACT

A display apparatus includes a wall portion having an opening defined by an opening edge portion that surrounds the opening. The opening defines an opening width and an opening height and the opening edge portion, at least in part, is generally defined by a first plane. The apparatus also includes a face frame portion having an outer frame edge, an inner frame edge, a first frame surface, a generally opposing second frame surface. The apparatus further includes a recessed portion having a first outer peripheral edge surrounding a central recess. The recessed portion at least partially extends into the opening. The inner frame edge includes a peripheral bead for at least partially guiding a working tool as a compound is applied to at least a portion of the first frame surface. The second frame surface selectively abuts the opening edge portion.

11 Claims, 7 Drawing Sheets

ARCHITECTURAL ELEMENT FOR WALL BOARD

CROSS REFERENCE TO RELATED APPLICATIONS

This application claims priority to U.S. Provisional Patent Application 60/806,782, filed Jul. 8, 2006, the disclosure of which is incorporated by reference in its entirety.

TECHNICAL FIELD

The disclosure generally relates to display devices and more specifically relates to flush wall-mounted devices that include a recess.

BACKGROUND

An item may typically be displayed by providing a shelf attached to a wall. Other items, such as paintings or pictures, may be positioned within a frame for protection and attached to a wall to position the item at a desirable height for viewing. However, a shelf or a frame may not provide a desired amount of protection for an item (such as when located in a high traffic area) or a user may not wish an item to be viewed from an extreme angle that elongates and obscures an item, such as a painting, when compared to viewing from a more frontal position. What is needed, therefore, is a display device that will provide greater protection for an item and offer more versatility of display.

BRIEF DESCRIPTION OF THE DRAWINGS

Referring now to the drawings, illustrative embodiments are shown in detail. Although the drawings represent some embodiments, the drawings are not necessarily to scale and certain features may be exaggerated, removed, or partially sectioned to better illustrate and explain the present invention. Further, the embodiments set forth herein are exemplary and are not intended to be exhaustive or otherwise limit or restrict the claims to the precise forms and configurations shown in the drawings and disclosed in the following detailed description.

DETAILED DESCRIPTION

Figure 1:
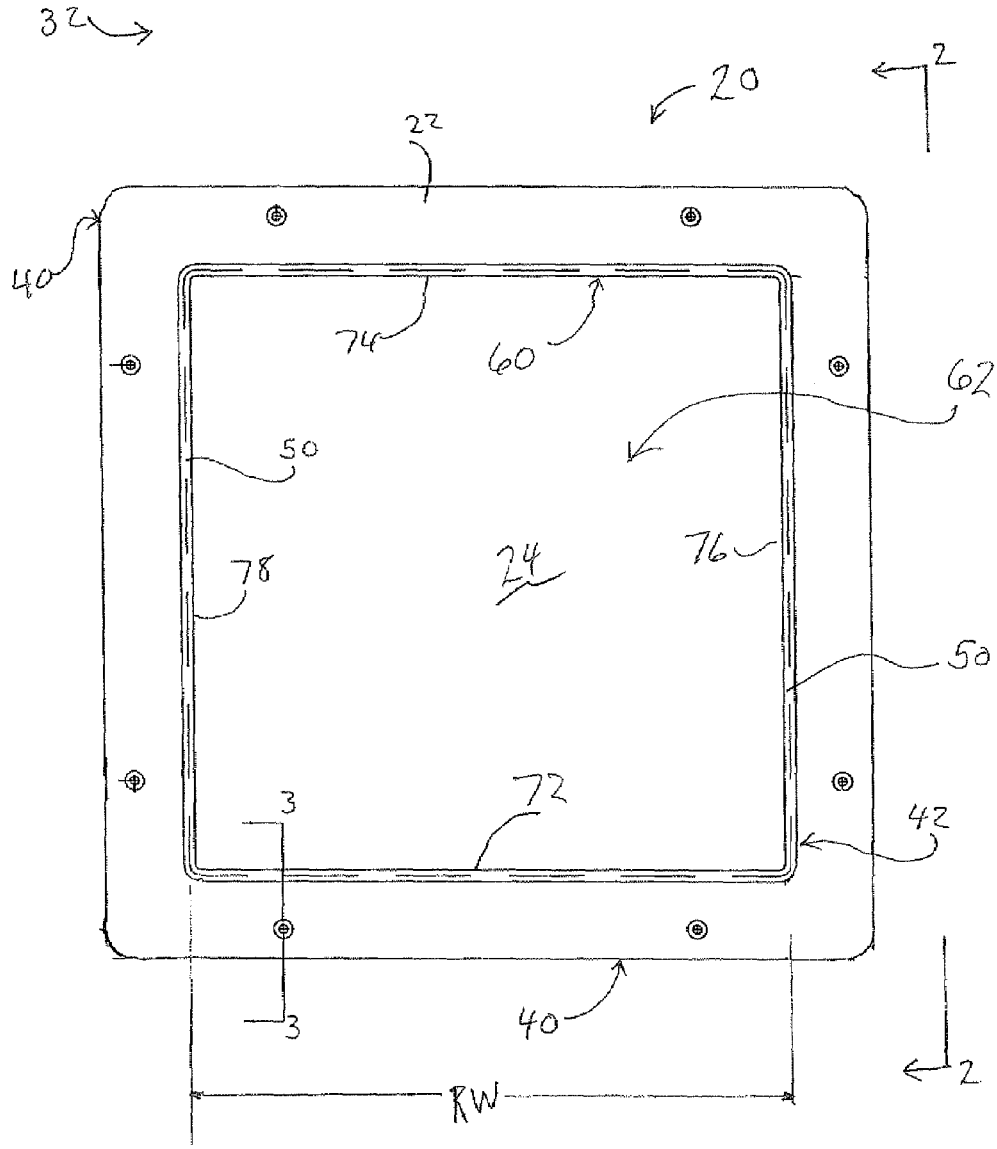
FIG. 1 is a front view of a device, according to an embodiment, prior to full installation.
Figure 2:
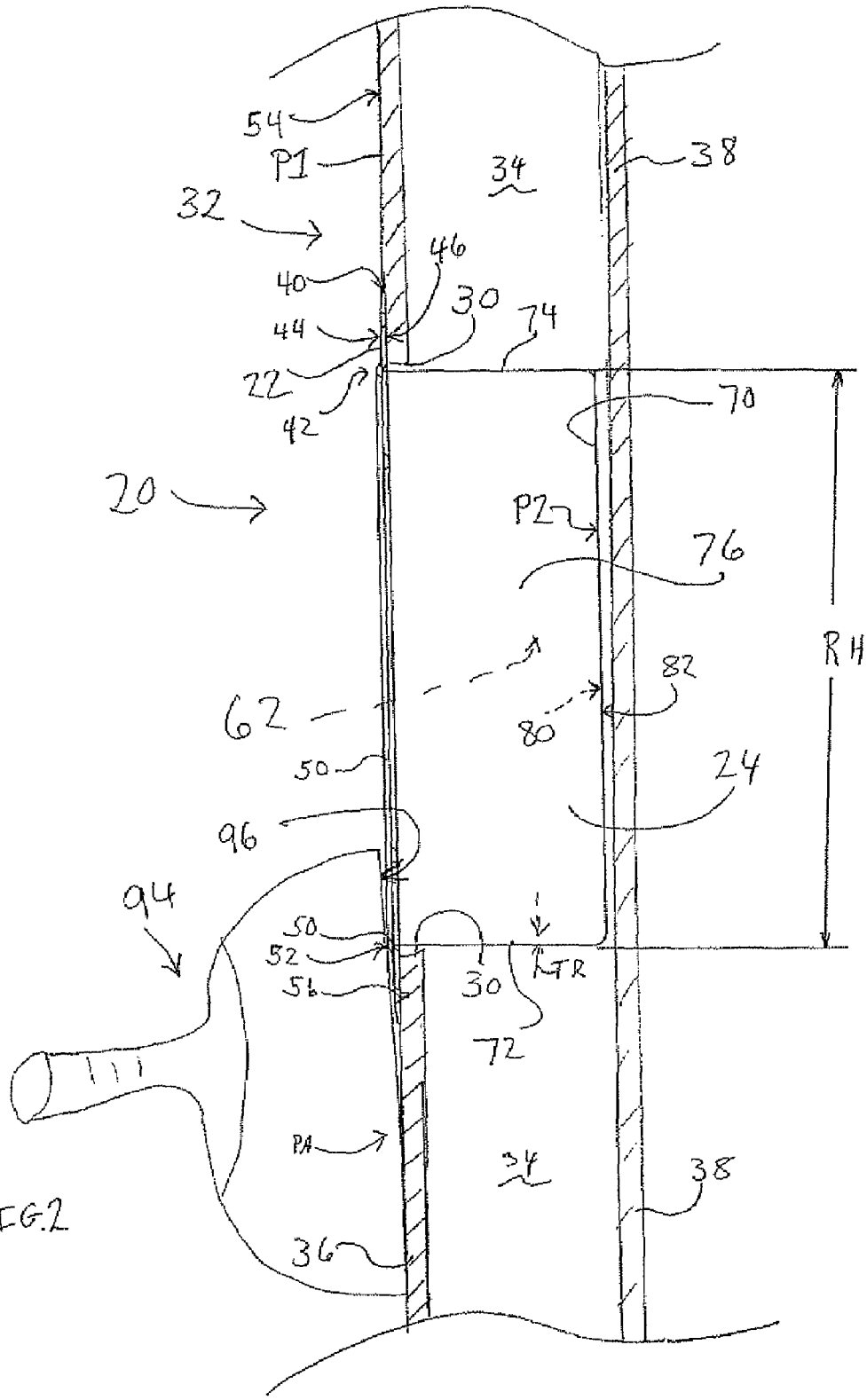
FIG. 2 is a side view of the device of FIG. 1, as a compound is applied.
Figure 3:
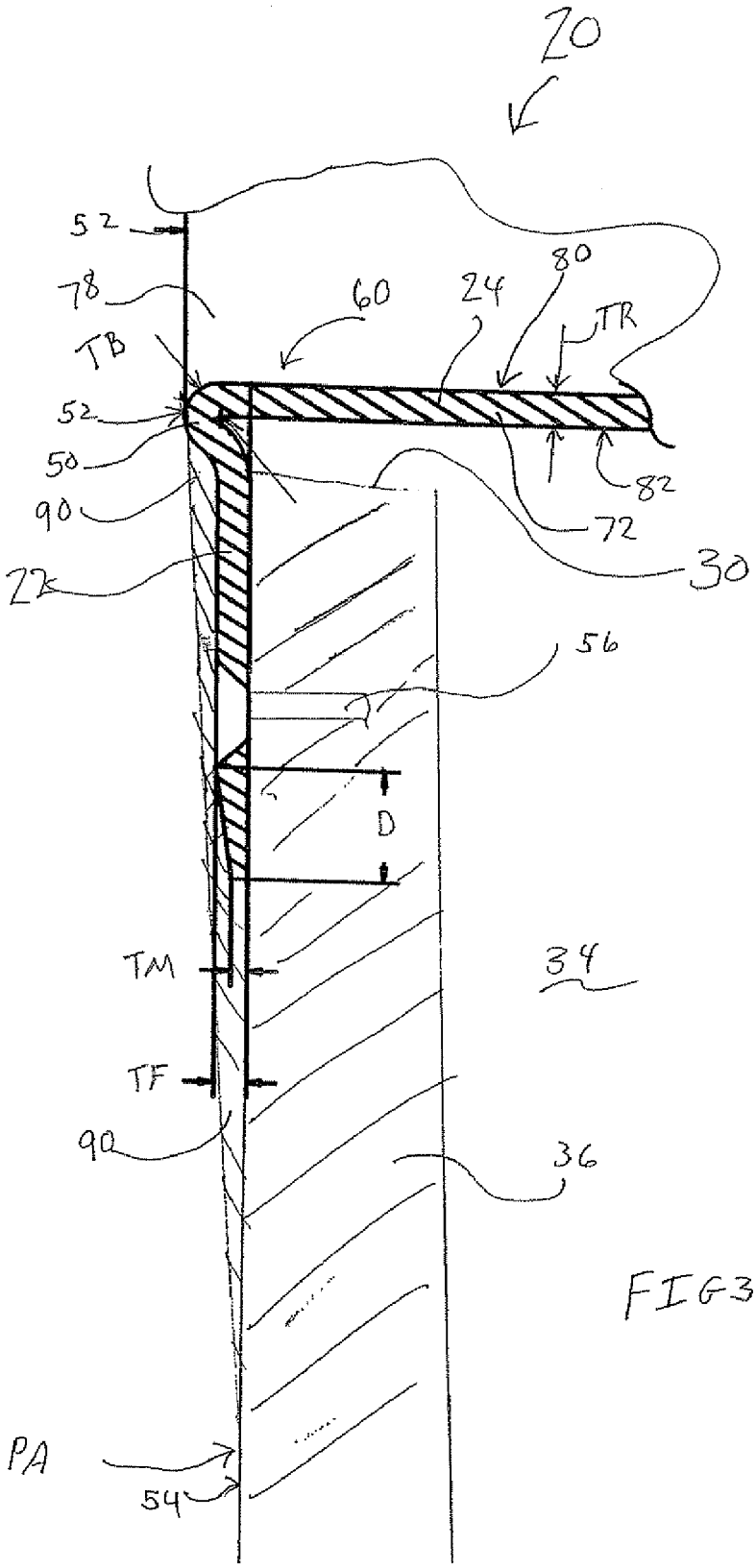
FIG. 3 is an enlarged sectional view taken along line 3-3 of FIG. 1, after the compound is applied.

FIGS. 1-3 illustrate an architectural element, or display device, 20. The device 20 includes a frame portion 22, and a recessed portion 24. The device 20 is illustrated at least partially within a wall opening 30 of a wall 32. In the embodiment illustrated, the wall 32 includes a plurality of vertical studs 34, a first wall board portion 36, and a second wall board portion 38, as is common in wall construction. The wall opening 30 is formed in the first wall board portion 36.

As best seen in FIG. 1, the frame portion 22 includes an outer frame peripheral edge 40, an inner frame edge portion 42, a first frame surface 44, and a generally opposing second frame surface 46 (FIG. 3). In the embodiment illustrated, the frame portion 22 is generally defined by a thickness TF measured between the first frame surface 44 and the second frame surface 46. In the embodiment illustrated, the frame portion 22 further includes a generally continuous bead 50 having an outmost bead surface 52 and defined by a bead thickness TB (FIG. 3) that is about equal to the thickness TF.

As best seen in FIG. 2, the first wall board portion 36 is defined by a front surface 54 that generally defines a first plane P1. The device 20 may be coupled to the wall 32 by means of fasteners 56. Additionally, the frame thickness TF may reduce toward a minor thickness as the frame portion 22 is tapered toward the outer frame peripheral edge 40.

The recessed portion 24 includes a first outer peripheral edge portion 60 surrounding a central recess portion 62. The inner frame edge portion 42 is connected to the first outer peripheral edge portion 60. In the embodiment illustrated, the central recess portion 62 includes a rear portion 70 generally defined by a second plane P2 that is generally parallel to the first plane P1, a lower connecting portion 72, an upper connecting portion 74, a first side portion 76, and a second side portion 78. The central recess portion 62 also includes a first recess surface 80 and a second recess surface 82 generally defining a recess thickness TR (FIG. 3) therebetween. As illustrated, the central recess portion 62 is defined by a recess portion width RW and a recess portion height RH.

In the embodiment illustrated, the ratio of the ratio of the frame thickness TF to the recess portion width RW is about 0.01, and the ratio of the frame thickness TF to the recess portion height RH frame thickness TF is about 0.01, although other ratios are contemplated. Also in the embodiment illustrated, the frame portion 22 is generally planar for mounting to a generally planar wall, although any contour or curvature of the frame portion 22 may be provided, as desired.

As best seen in at least one of FIGS. 1-3, the outer frame peripheral edge 40 is defined by a generally planar portion of the first frame surface 44 and mated to a portion of the front surface 54 of the opening 30. The recess portion 62 at least partially extends into the opening 30. The inner frame edge portion 42 is defined, at least in part, by the peripheral bead 50. In the embodiment illustrated, the bead 50 is continuous and circumscribes the recess portion 62.

In one example of installing the device 20, a suitable wall, such as the wall 32 is chosen. The wall may be of various constructions, but a wall framed with 2×4 studs and covered on two sides with wall board is chosen for this exemplary method. The opening 30 is formed in the wall 32 with sufficient height RH and width RW to accommodate the recess portion 62. The device 20 is then interposed at least partially within the opening 30 as illustrated in FIGS. 1-3 (with the second frame surface 46 abuts the front surface 54) and secured with fasteners 56.

The device 20 may then be further flush mounted by applying a compound 90, such as a typical wall board compound, to the frame portion 22 as illustrated in FIG. 2. When applying the compound 90, a working tool, such as a putty knife 94 is used to smooth the compound 90 as the knife edge 96 is guided along the bead 50. As illustrated, the compound 90 is applied to the frame portion 22 and the front surface 54 of the first wall board portion 36 from the bead to a peripheral area PA. Application of the compound 90 may provide the device 20 with a 'flush mount' appearance that provides clean lines and a desirable aesthetic appearance. As is known, the compound 90 may then be painted to match the front surface 54 with paints that are compatible with the front surface 54.

The device 20 may be then used to display items (not shown) on the generally horizontal first recess surface 80 of the lower connecting portion 72. This method of installation of the device 20 and display of an item may better protect the item from sunlight or inadvertent damage.

Figure 4:
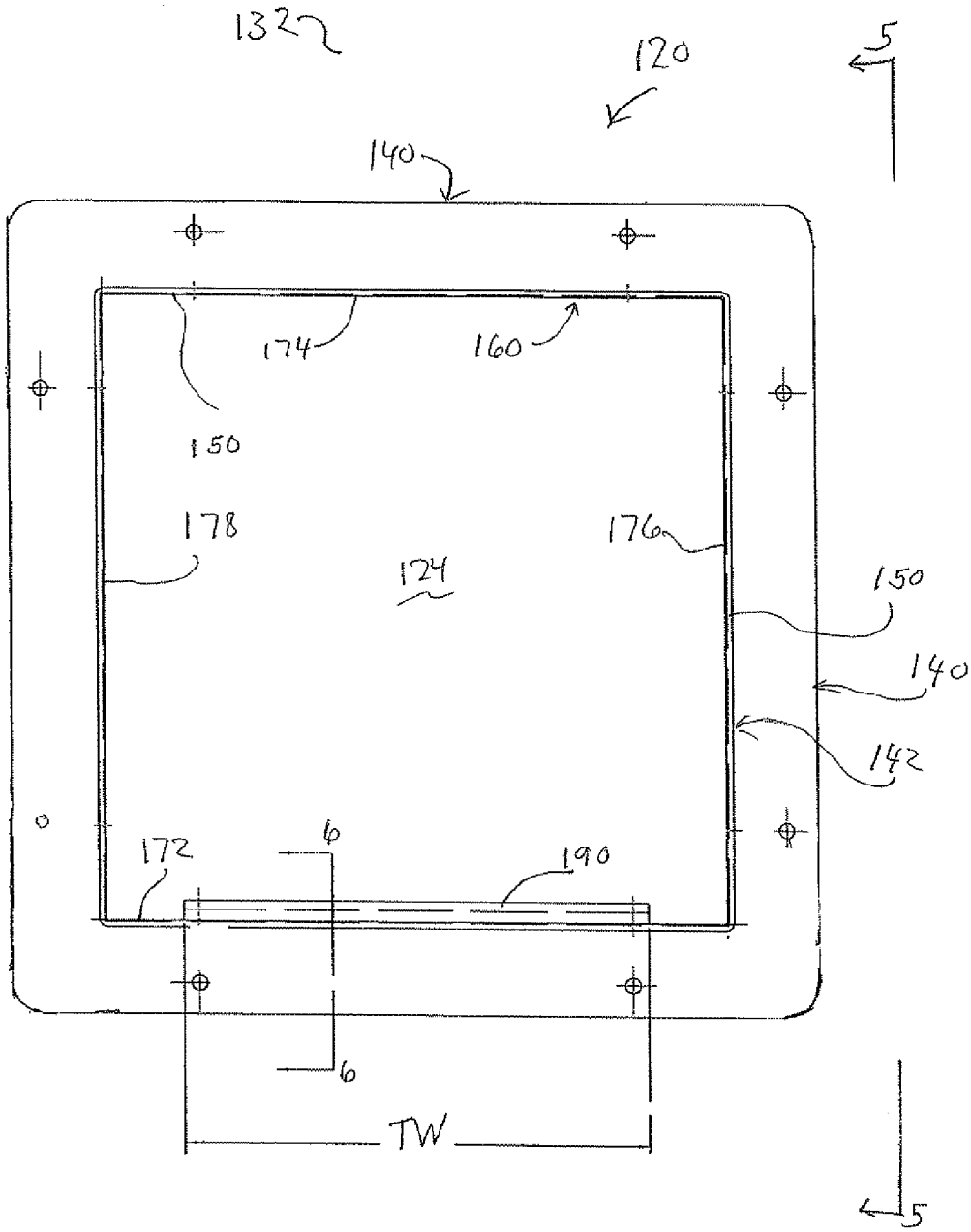
FIG. 4 is a front view of a device, according to an embodiment.

As best illustrated in FIG. 4, an alternative embodiment of the device 20 is illustrated as an architectural element, or display device, 120. The device 120 includes a frame portion 122, and a recessed portion 124. The device 120 is illustrated at least partially within a wall opening 130 of a wall 132. In the embodiment illustrated, the wall 132 includes a plurality of vertical studs 134, a first wall board portion 136, and a second wall board portion 138, as is common in wall construction. The wall opening 130 is formed in the first wall board portion 136.

Figure 5:
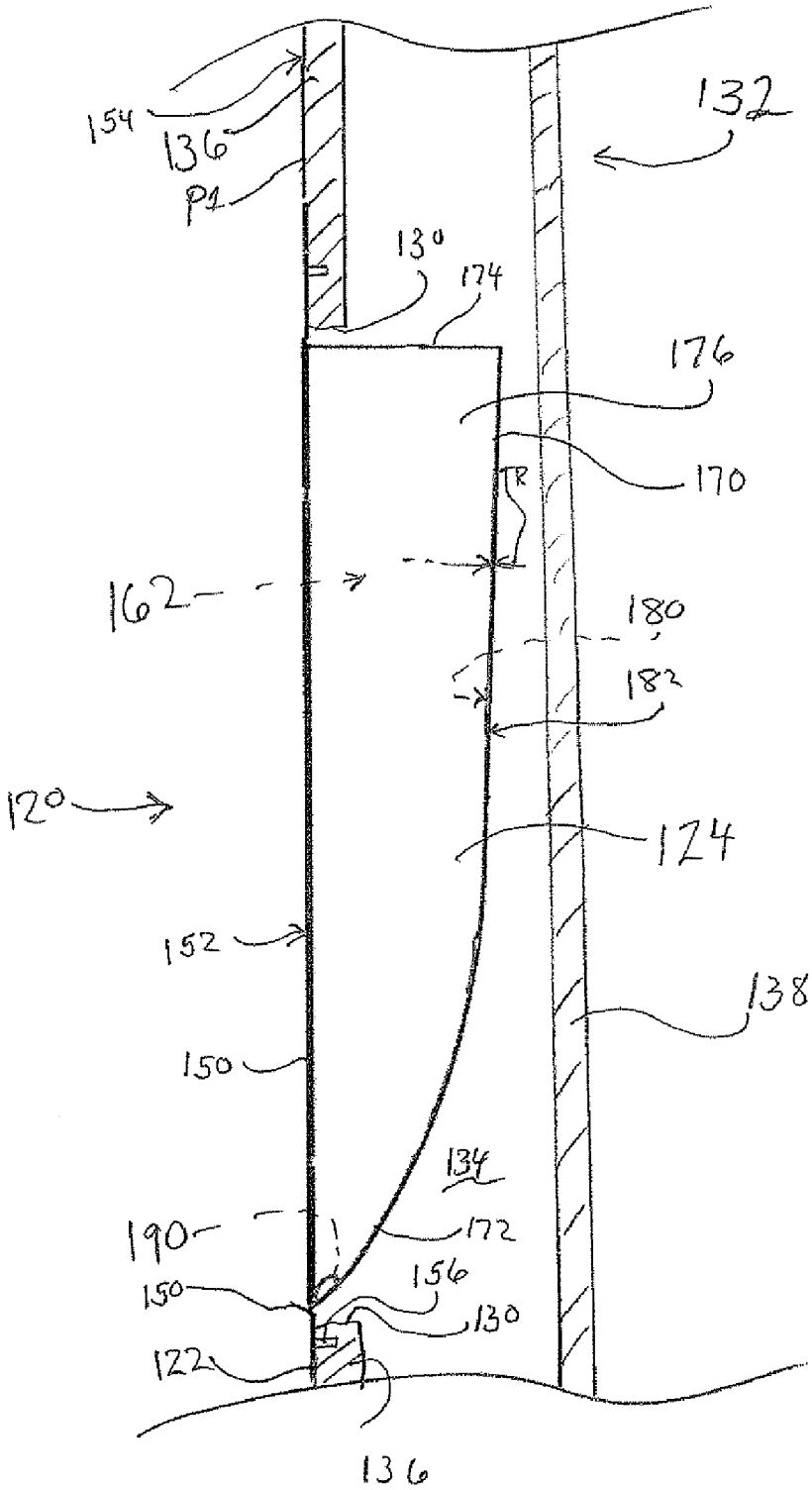
FIG. 5 is a side view of the device of FIG. 4.
Figure 6:
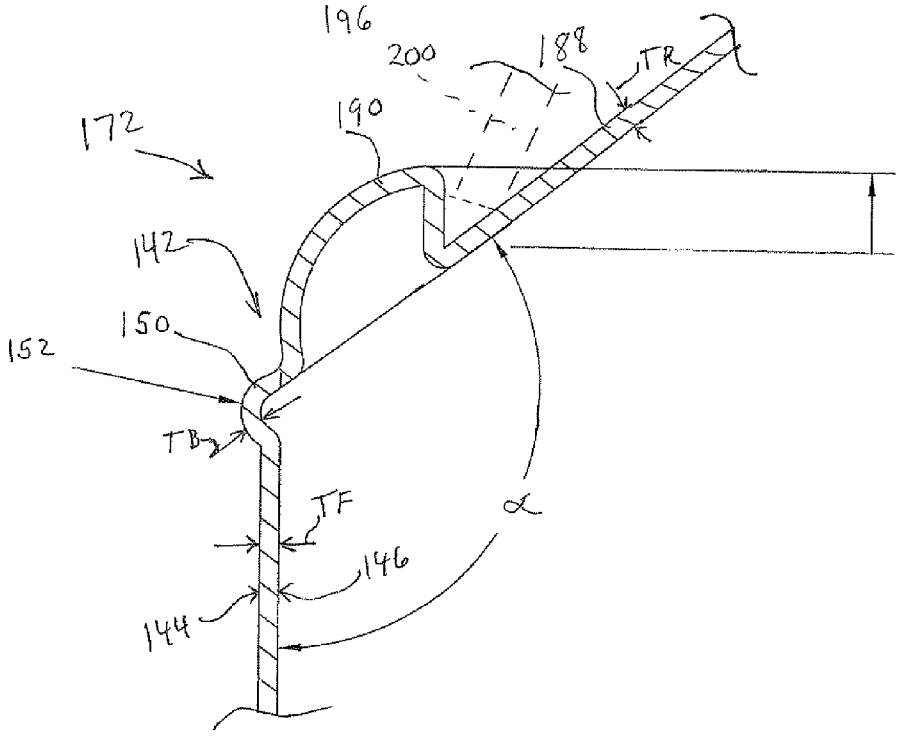
FIG. 6 is an enlarged sectional view taken along line 6-6 of FIG. 4.

As best seen in FIGS. 4-6, the frame portion 122 includes an outer frame peripheral edge 140, an inner frame edge portion 142, a first frame surface 144, and a generally opposing second frame surface 146. In the embodiment illustrated, the frame portion 122 is generally defined by a thickness TF measured between the first frame surface 144 and the second frame surface 146. In the embodiment illustrated, the frame portion 122 further includes a generally continuous bead 150 having an outmost bead surface 152 and defined by a bead thickness TB that is about equal to the thickness TF.

As best seen in FIG. 5, the first wall board portion 136 is defined by a front surface 154 that generally defines a first plane P1. The device 120 may be coupled to the wall 132 by means of fasteners 156. Additionally, the frame thickness TF may reduce toward a minor thickness as the frame portion 122 is tapered toward the outer frame peripheral edge 140.

The recessed portion 124 includes a first outer peripheral edge portion 160 surrounding a central recess portion 162. The inner frame edge portion 142 is connected to the first outer peripheral edge 160. In the embodiment illustrated, the central recess portion 162 includes a rear portion 170 partially defined by a second plane P2 that is generally parallel to the first plane P1, a lower connecting portion 172, an upper connecting portion 174, a first side portion 176, and a second side portion 178. The central recess portion 162 also includes a first recess surface 180 and a second recess surface 182 generally defining a recess thickness TR therebetween. As illustrated, the central recess portion 162 is defined by a recess portion width RW and a recess portion height RH.

The lower connecting portion 172 includes a curved inner portion 188 extending to a lip portion 190. The lip portion 190 includes a curved portion 192 and a vertical portion 194, and is for at least partially retaining an item (illustrated in phantom at 200) for display. In the embodiment illustrated, the lip portion 190 includes a lip width TW (FIG. 4), and a lip thickness TL (FIG. 6) that is about equal to the thicknesses TB, TF, TR.

In the embodiment illustrated, the ratio of the ratio of the frame thickness TF to the recess portion width RW is about 0.01, and the ratio of the frame thickness TF to the recess portion height RH frame thickness TF is about 0.01, although other ratios are contemplated.

As best seen in at least one of FIGS. 4-6, the outer frame peripheral edge 140 is defined by a generally planar portion of the first frame surface 144 and mated to a portion of the front surface 154 of the opening 130. The recess portion 162 at least partially extends into the opening 130. The inner frame edge portion 142 is defined, at least in part, by the peripheral bead 150. In the embodiment illustrated, the bead 150 is continuous and circumscribes the recess portion 162.

The device 120 is installed in similar manner as the method of installation of the device 20 described above.

As will be appreciated, the forming process chosen for the device 20 may dictate that the thicknesses TB, TF, TR vary slightly as the device is formed. For example, if a vacuum forming process is chosen using a generally uniform thickness sheet of heated arcylonitrile butadiene styrene (ABS), the thickness TR may be slightly less than (although generally equal to) the thickness TF. In a typical vacuum forming process, at least a portion of the recess portion and at least a portion of the peripheral bead are formed simultaneously.

Figure 7:
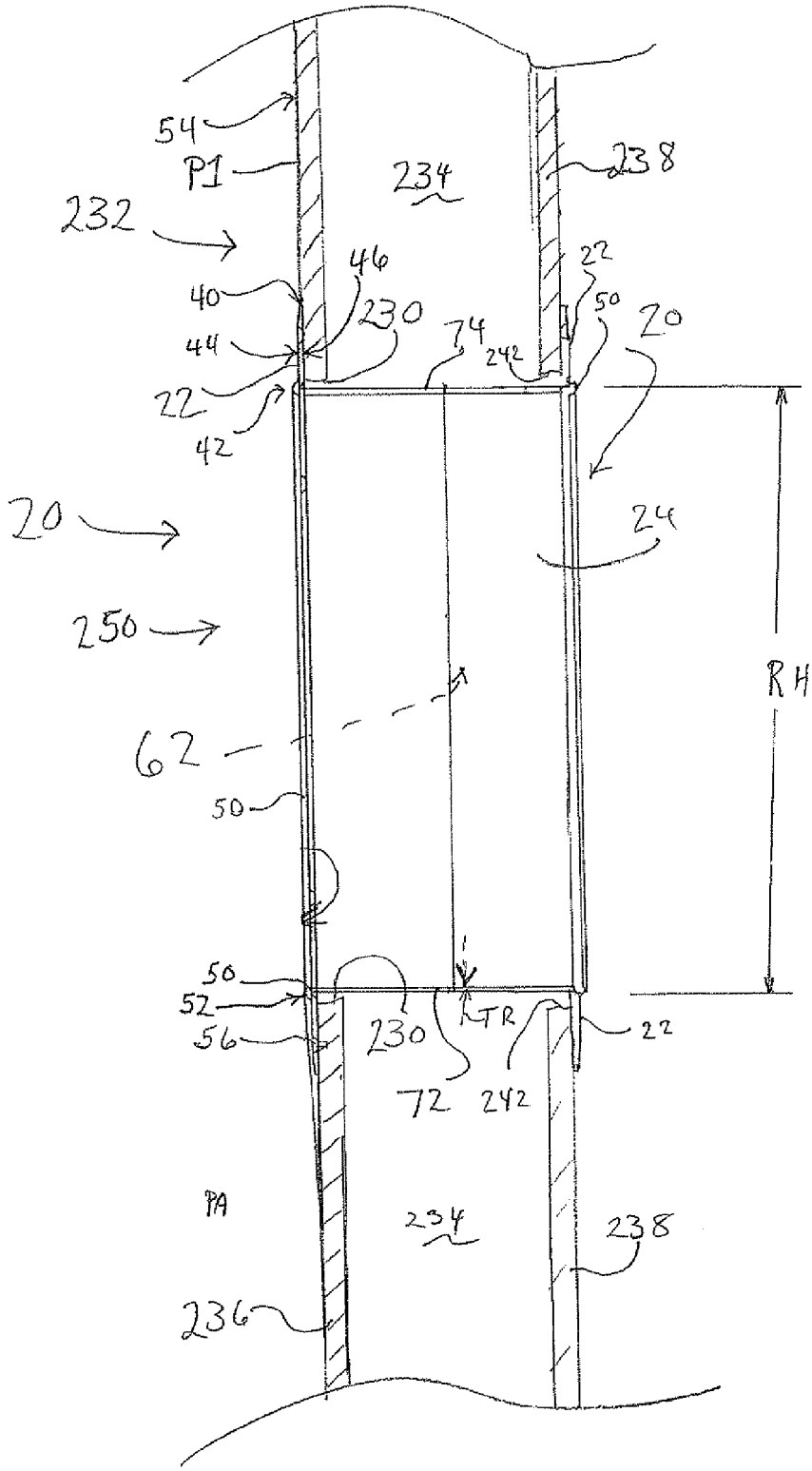
FIG. 7 illustrates portions of two devices of FIG. 1 for providing a through opening in a wall.

FIG. 7 illustrates a wall 232 having portions of two devices 20 installed therein. The wall 232 includes a plurality of vertical studs 234, a first wall board portion 236, and a second wall board portion 238, as is common in wall construction. A wall opening 230 is formed in the first wall board portion 236 and a generally aligned wall opening 242 is formed in the second wall board portion 238.

The devices 20 of FIG. 7 have portions of the recess portions 62 (including the rear portions 70) removed. In an installed configuration of FIG. 7, the recess portions of the devices 20 align (with or without the aid of alignment features) to provide a central opening 250 through the wall 232. The frame portions 22 may be fastened and finished with a compound, such as the compound 90, as described above.

In one example of installing the device 20, a suitable wall, such as the wall 32 is chosen. The wall may be of various constructions, but a wall framed with 2×4 studs and covered on two sides with wall board is chosen for this exemplary method. The opening 230 is formed in the wall 232 with sufficient height RH and width RW to accommodate the recess portion 62. The device 20 is then interposed at least partially within the opening 30 as illustrated in FIGS. 1-3 (with the second frame surface 46 abuts the front surface 54) and secured with fasteners 56.

While these embodiments illustrated herein provide a discussion of some features, other features, such as a light positioned within (such as within the recessed area 24) or behind (such as between the rear portion 170 and the second wall board portion 138) the device 20, 120 may be provided. Further, the frame portion 22, 122, 222 may be finished as a decorative frame (such as a picture frame) for a semi-recessed mounting that does not require the application of compound 90.

Such as described, the devices described herein provide a faster and more repeatable method of providing an insert, niche, or opening than conventional methods.

Although the steps of the method of installing the devices are listed in a preferred order, the steps may be performed in differing orders or combined such that one operation may perform multiple steps. Furthermore, a step or steps may be initiated before another step or steps are completed, or a step or steps may be initiated and completed after initiation and before completion of (during the performance of) other steps.

The preceding description has been presented only to illustrate and describe exemplary embodiments of the methods and systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A display apparatus and wall opening comprising:

a wall portion having an opening defined by an opening edge portion that surrounds the opening, wherein the opening defines an opening width and an opening height and the opening edge portion, at least in part, is generally defined by a first plane;

a face frame portion having an outer frame edge, an inner frame edge, a first frame surface, a generally opposing second frame surface; and a recess portion having a first outer peripheral edge surrounding a central recess, wherein the recess portion defines a recess portion width and a recess portion height and includes a curved inner portion extending to a lip for at least partially retaining an item for display, wherein at least a portion of the curved inner portion is recessed within the opening;

wherein the inner frame edge is connected to the first outer peripheral edge, the outer frame edge is defined by a generally planar peripheral portion selectively mated to a portion of the opening edge portion, the recessed portion at least partially extends into the opening, the inner frame edge includes a peripheral bead which is raised above the first frame surface, partially guiding a working tool as a wall board compound is applied to at least a portion of the first frame surface, and wherein the second frame surface selectively abuts the opening edge portion.

2. The apparatus of claim 1, further comprising a second frame portion mated to a second opening in the wall portion.

3. The apparatus of claim 1, wherein the compound is applied to the first surface such that the outer frame edge is not visible when viewing a fully installed display apparatus.

4. The apparatus of claim 1, wherein the apparatus includes a generally constant thickness throughout.

5. The apparatus of claim 1, wherein the recess portion and the inner frame edge have a generally equal constant thickness throughout and the outer frame edge has a generally tapered thickness that is reduced at an extreme peripheral edge.

6. The apparatus of claim 5, wherein the ratio of the thickness of the inner frame edge to the recess portion width or the recess portion height is less than about 0.01.

7. The apparatus of claim 1, wherein the central recess includes a rear portion generally defined by a second plane that is generally parallel to the first plane.

8. A method of forming a display apparatus at least partially within a wall opening comprising:

forming a frame portion having inner frame edge;

forming a recess portion;

forming a peripheral bead on the inner frame edge;

positioning the recess portion within a wall opening;

coupling a first frame surface mechanically to a wall board; and applying a paintable wall board compound to at least a portion of the first frame surface providing a flush mount appearance, wherein the peripheral bead is raised above the first frame surface.

9. The method of claim 8, further comprising securing at least a portion of the frame portion to a wall portion adjacent the wall opening.

10. The method of claim 8, wherein at least a portion of forming the recess portion and at least a portion of forming the peripheral bead are formed simultaneously.

11. The apparatus of claim 1, wherein the wall board compound is painted to match the front surface of said wall board.

* * * * *